United States Patent [19]

Bolldorf et al.

[11] 4,134,346

[45] Jan. 16, 1979

[54] BUTTONHOLE SEWING MACHINE

[75] Inventors: Kurt Bolldorf; Walter Hager, both of Kaiserslautern; Günter Tölle, Bruchsal, all of Germany

[73] Assignee: Firma Pfaff Industriemaschinen GmbH, Germany

[21] Appl. No.: 845,942

[22] Filed: Oct. 27, 1977

[30] Foreign Application Priority Data

Oct. 30, 1976 [DE] Fed. Rep. of Germany ..... 2650032

[51] Int. Cl.[2] ..... D05B 3/06

[52] U.S. Cl. ..... 112/70; 112/76; 112/278

[58] Field of Search ..... 112/70, 76, 65, 67, 112/273, 278

[56] References Cited

U.S. PATENT DOCUMENTS

| | | | |
|---|---|---|---|
| 3,741,138 | 6/1973 | Heimann et al. | 112/273 X |
| 3,847,101 | 11/1974 | Tolle | 112/70 X |

*Primary Examiner*—H. Hampton Hunter
*Attorney, Agent, or Firm*—McGlew and Tuttle

[57] ABSTRACT

A sewing machine for sewing buttonholes in a workpiece comprises a stationary lower part and an arm having one end pivotally mounted on the lower part and having an opposite end which carries a rotary hook which cooperates with a reciprocating needle carried in the lower part. The arm is pivotal relative to the base part to move the arm from a fixable sewing position with said hook spaced by a predetermined distance from the needle at a stitch-forming area to a rest position in which it is spaced away from the stitch-forming area. A thread-monitoring device is located adjacent the needle for monitoring the thread and detecting any breakage thereof. The machine includes a buttonhole cutting mechanism which is connected to the drive means so as to periodically cut the workpiece. A clamp is carried by the upper arm and it has a lower portion which rests on a resilient support which is biased upwardly by a spring. The upper part of the clamp carries a rod which is biased downwardly by a spring having a lower characteristic than the spring biasing the arm upwardly, and it engages over a presser frame to urge the frame into engagement with the workpiece. A locking mechanism is associated with the support upon which the lower clamping part rests, and it is effective to lock the support arm in a selected position whenever it is actuated by the thread monitor.

4 Claims, 3 Drawing Figures

BUTTONHOLE SEWING MACHINE

FIELD AND BACKGROUND OF THE INVENTION

This invention relates in general to sewing machines and, in particular, to a new and useful buttonhole sewing machine, comprising a stationary lower part, an arm which is pivotally mounted on the lower part and movable from a fixable sewing position into a rest position in which it is turned away from the stitch-forming area, a rotary hook which cooperates with a needle guided in the lower part and penetrating the work from below upwardly, a buttonhole cutting mechanism, a thread monitoring equipment, a displaceable work clamp including a base clamping part which is mounted on the lower part and rests against a resilient support and a top clamping part which, in the sewing position of the arm, rests against the arm.

DESCRIPTION OF THE PRIOR ART

Stitch group sewing machines, particularly buttonhole sewing machines, are usually equipped with a thread monitoring device by which, upon a breakage of the thread, both the main shaft of the machine is stopped and the cutting of the unfinished buttonhole by the buttonhole cutting mechanism is prevented. Since in case of thread breakage, the unfinished buttonhole is once again completely resewn in a second sewing operation, care must be taken to have the previously begun unfinished buttonhole seam covered by the second buttonhole seam.

To be able to maintain the same relative position of the work and the work clamp in the second operation, as in the first sewing operation, known devices (German Utility Model No. 1,934,428) are designed in a manner such that upon stoppage of the main shaft of the machine, caused by thread breakage, the work clamp is not opened, i.e., the top clamping part is not lifted. In sewing machines in which the hook is provided below the needle plate and the needle above the needle plate, this may easily be done, since the hook is always accessible, independent of the position of the work clamp, and the closed work clamp does not hinder the threading of the needle in any way.

The conditions are different in a sewing machine where the hook is provided above the needle plate and the needle below the needle plate. In such machines, if the work clamp, the base part of which serves at the same time as the needle plate, remains in its closed position, it hinders the free access to the needle eye quite considerably, so that with a closed work clamp, the needle can only be threaded while using an auxiliary tool, for example, tweezers.

SUMMARY OF THE INVENTION

The present invention is directed to a sewing machine having its needle disposed below the needle plate and being of such design that upon stoppage of the main shaft of the machine following a thread breakage, the needle eye is freely accessible while the clamping position of the work clamp is still maintained. For this purpose, in a buttonhole sewing machine in accordance with the invention, the movability in height of the support is controllable by a locking mechanism, the actuation of which is made dependent on the thread monitoring device.

The result is thereby obtained that with a regularly made buttonhole, the base part of the work clamp remains in its substantially horizontal position, so that with the hook arm or top part of the clamp moving upwardly, the work clamp is opened. In the absence of a regularly finished buttonhole, i.e., upon a response of the thread monitoring device, the locking mechanism hitherto limiting the vertical movement of the support is disengaged. With the hook arm or top clamping part moving upwardly, the base clamping part, due to the at least partly expanding spring of the support, moves by a certain distance upwardly, in synchronism with the top clamping part, so that the access to the eye of the needle occupying its lowermost position is cleared, but the clamping position of the top and base parts of the clamps is still maintained.

The invention is further directed to a design such that the locking mechanism is actuated while an actuating element to be controlled in addition is avoided.

In accordance with the invention, this is obtained by providing that the disengagement of the locking mechanism is made dependent on the movement of the work clamp and the return of the locking mechanism into its effective position is made dependent on the movement of the buttonhole cutting knife. In this way, the locking mechanism is disengaged during the sewing operation, but the hook arm, which is moved into the sewing position, prevents the base or top clamping part from moving upwardly. In the absence of a working motion of the knife of the buttonhole cutting mechanism at the end of the sewing operation, the locking mechanism, disengaged by the work clamp, remains in its ineffective position and, with the spring of the support expanding, allows the base and top parts of the work clamp to move upwardly in synchronism.

A suitable constructional solution in this respect is that the locking mechanism comprises a slide which is movable into a recess of a pin forming the support, and is also provided with an extension projecting into the path of motion of the work clamp and is connected to the drive of the buttonhole cutting knife through a drive transmission functioning with an idle stroke.

Since the slide is not rigidly connected to its drive means which moves it to the respective position in either its effective position, or in its rest position, upon reaching such a position, the slide could move independently and therefore a possibility of arresting the slide both in its effective and in its rest position is provided.

Accordingly, it is an object of the invention to provide an improved sewing machine for sewing a buttonhole in a workpiece, which comprises a stationary lower part and an arm which is pivoted to the lower part and contains a workpiece clamping mechanism with a lower part which rests on an upwardly biased support and which includes locking means for locking the support in response to the monitoring of the needle thread.

A further object of the invention is to provide a sewing machine for sewing buttonholes which is simple in design, rugged in construction and economical to manufacture.

For an understanding of the principles of the invention, reference is made to the following description of a typical embodiment thereof as illustrated in the accompanying drawing.

DESCRIPTION OF THE PREFERRED EMBODIMENT

Figure 1:
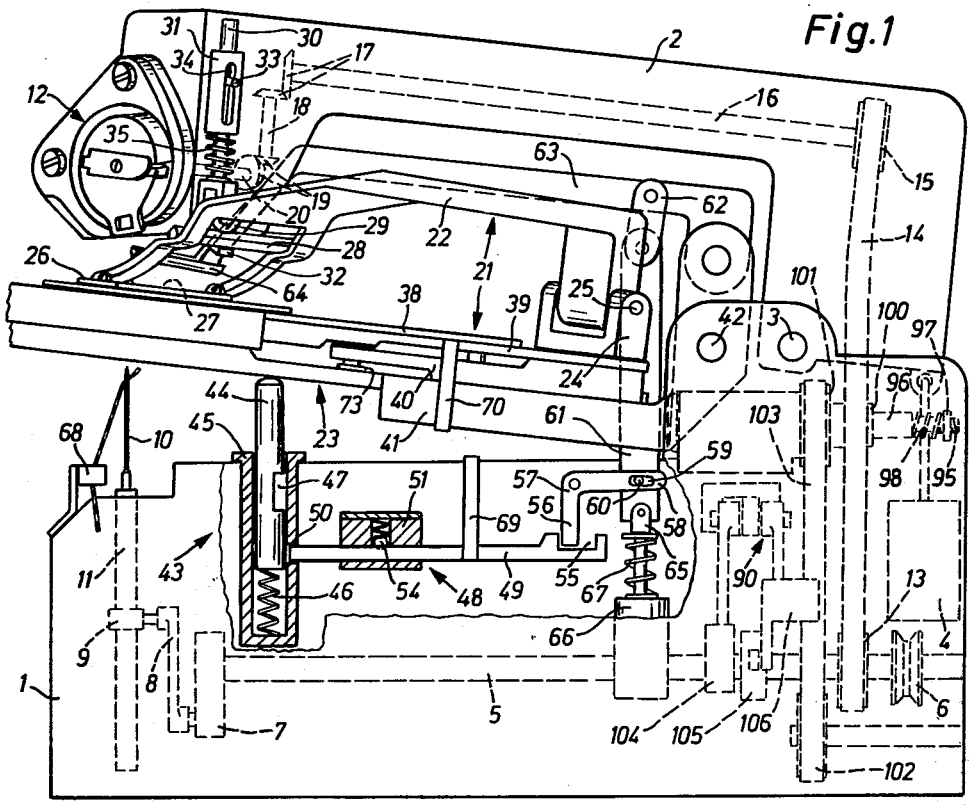
FIG. 1 is a side elevational view partly in section of a sewing machine constructed in accordance with the invention with a lifted work clamp in a closed position.

As an example of embodiment of the invention, the drawing shows a buttonhole sewing machine comprising a stationary lower part 1 and an arm 2 which is pivotally mounted on a pivot pin 3 secured to lower part 1. To pivot arm 2 from its sewing position into its rest position in which it is turned away from the stitch forming area, the arm is connected, laterally of pivot pin 3, to the armature of a double-action electromagnet 4 which can be arrested in its end position, so that both the sewing position and the rest position of arm 2 are definite. It would also be possible to arrest arm 2 in its two positions by appropriate stops.

A main shaft 5, carrying a belt pulley 6 which is driven by a stop motor (not shown), is mounted in the lower part 1 of the sewing machine. At the other end of the main shaft 5, a crank 7 is provided, which drives, through a link 8 and an intermediate member 9, a needle bar 11 carrying a thread guiding needle 10. Thus, needle 10 pierces the work from below upwardly and it cooperates with a rotary hook 12 which is mounted on the front side of arm 2.

To drive hook 12, main shaft 5 carries a belt pulley 13 secured thereto, by which a shaft 16, mounted in arm 2, is driven through a cog belt 14 and an associated pulley 15, which in turn, imparts a rotary motion through two bevel gears 17 to a vertically extending shaft 18. Shaft 18 drives the shaft 20 of hook 12 through another pair of bevel gears 19, whereby, the hook is driven through the described transmission train at a speed rate of 2:1 relative to the motion of the needle.

In order to receive the work, the sewing machine of the invention is provided with a work clamp 21 which is formed substantially by a top clamping part 22 and a base clamping part 23. Top clamping part 22 is supported on a bearing bracket 24 secured to base clamping part 23 and is pivotable about a pivot pin 25 extending obliquely to main shaft 5 of the machine. At the front end of top clamping part 22, a clamping frame 26 is mounted, pressing ehe work in a manner known per se against base clamping part 23, which frame is provided with an aperture 27 for the passage of needle 10 and the passage of a buttonhole knife which will be described hereinafter in more detail. The front end of top clamping part 22 is further provided with a pressure rail 28 extending parallel to the work feed direction and cooperating with a pressing roller 29 rolling thereon.

Pressing roller 29 is mounted for free rotation on the lower forked end of a guide rod 30 which is received for displacement within a lug 31 of arm 2. At its lower end, guide rod 30 is equipped with a dog 32 engaging pressure rail 28 from below. Guide rod 30 carries a pin 33 which extends perpendicularly to the longitudinal axis of the rod and slides within an oblong slot 34 extending parallel to the longitudinal axis of the rod, thereby limiting the mobility of guide rod 30 in the longitudinal direction thereof. A spring 35 is provided between lug 31 and the lower end of guide rod 30 retains top clamping part 22 permanently in the lowermost position thereof.

Figure 2:
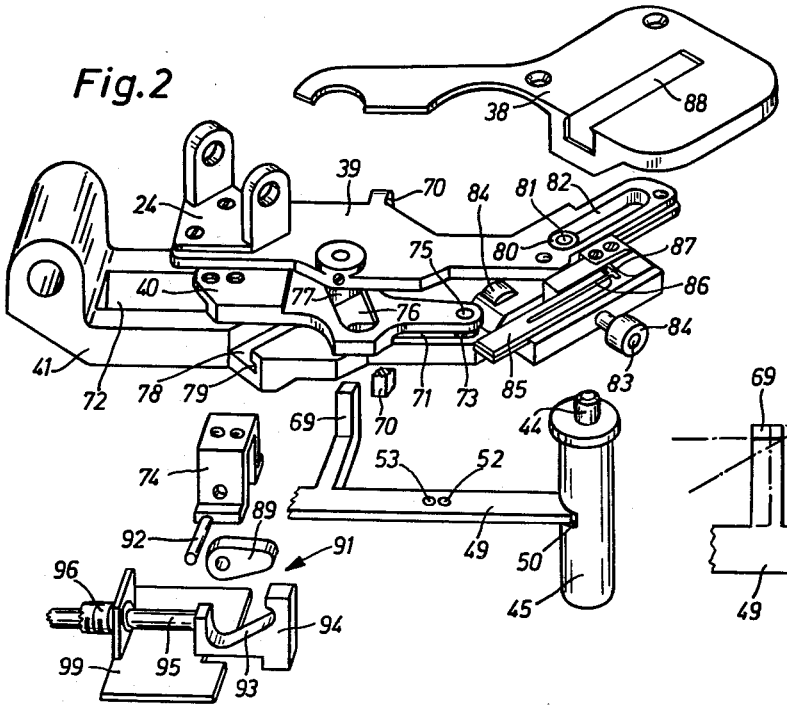
FIG. 2 is a perspective view of the work clamp.

As best seen in FIG. 2, base clamping part 23 comprises a cover plate 38, a work supporting plate 39, an intermediate plate 40 and a baseplate 41. The baseplate 41 is mounted on lower part 1 by means of a pivot pin 42 and rests in the zone of the stitch forming area against a support 43 which includes a pin 44 which is mounted for displacement in lower part 1. The pin 44 is mounted for displacement within a guide bushing 45 secured to lower part 1 and it is urged upwardly by means of a spring 46. The characteristic of spring 46 is steeper than that of the spring 35. Instead of spring 46, guide bushing 45 could be provided with a compressed air connection to form, together with pin 44, a pneumatic spring.

Pin 44 is provided with a recess 47 in which, with arm 2 in its sewing position, one end of a slide 49 performing the function of a locking mechanism 48 is engaged. The slide 49 projects through an aperture 50. Slide 49 is guided within a guide block 51 in its longitudinal direction. Slide 49 is provided with two recesses 52, 53 into which a spring-biased ball 54 of guide block 51 is engageable for arresting the slide in its two end positions.

Since the arm 2 in sewing position, the vertical positions of both work clamp 21 and of pin 44 are variable as a function of the work thickness, the height of recess 47 in pin 44 exceeds by a definite amount, the thickness of slide 49. This ensures that in the sewing position of arm 2, slide 49 is able to engage recess 47 indendently of the respective thickness of the work.

Slide 49 is provided with a jaw-like recess 55 at its other end, in which the end of an arm 56 of an angle lever 57, mounted in lower part 1, is received. For reasons which will be explained hereinafter, the width of this jaw-like recess is larger by a certain amount than the width of arm 56. In an oblong slot 59 provided in arm 58 of angle lever 57, a stud 60 is engaged which is carried by a lever 61 having an upper end connected to a knife bar 63 of a buttonhole cutting mechanism is connected through a link 62. Knife bar 63 which is substantially of U-shape configuration, is pivotally mounted to lower part 1 and, at its free end, it carries a buttonhole knife 64 of a well known design. The lower end of lever 61 is connected to the tie rod of an electromagnet 66 through a fork head 65.

At the end of a stitch forming cycle, the circuit of electromagnet 66 is closed at a first point of interruption by means of a cam of a program control (not shown), so that the electromagnet imparts a cutting motion to buttonhole knife 64 through the tie rod and against the action of a spring 67 surrounding this rod. Another contact (not shown) is provided in the circuit of electromagnet 66 by which the circuit is interrupted at a second point of interruption and which is actuated by a thread monitoring device 68 provided in the zone of needle 10. The design is such that the circuit of the electromagnet is opened as soon as thread monitoring device 68 indicates a thread breakage. In this way, it is ensured that with an irregularly finished buttonhole seam, the motion of buttonhole knife 64 and, thereby, a cutting of the buttonhole, is prevented.

Slide 49 is provided with an extension 69 projecting into the path of motion of a bar 70 which is secured to the work supporting plate 39 of base clamping part 23. Baseplate 41 is provided with two guideways 71 and 72 in which a roller 73 and a sliding member 74, respectively, are displaceably received. Both sliding member 74 and roller 73, which latter is rotatable about a vertical pin 75, are firmly connected to the intermediate plate 40 of base clamping part 23, whereby, plate 40 is guided in baseplate 41. Intermediate plate 40 is provided with a transverse guideway 76 which extends at an oblique angle to guideways 71 and 72 and through which a pin 77 is passed, having its lower end received in an oblique guideway 78 of baseplate 41, which guideway 78 extends at an oblique angle to the transverse guideway 78 of the intermediate plate.

Due to the provision of the two guideways 76, 78 in intermediate plate 40 and baseplate 41, respectively, as soon as intermediate plate 40 is displaced along guideways 71 and 72, pin 77 is displaced within oblique guideway 78 of baseplate 41, so that work supporting plate 39 which is secured to the upper end of pin 77 is moved in a direction parallel to guideway 78 of baseplate 41. To prevent pin 77 or work supporting plate 39 from lifting, the lower end of pin 77 is provided with a side flange which is slidably guided within a groove 79 of the guideway 78 of baseplate 41. To ensure an exactly parallel guidance of work supporting plate 39, a guide roller 80 is provided in the zone of the front end of baseplate 41 which roller is rotatably mounted on a pivot pin 81 which is secured to baseplate 41 and extends into a guide slot 82 of work supporting plate 39. The guide slot 82 is parallel to the oblique guideway 78 of baseplate 41.

For receiving the work, work supporting plate 39 is firmly connected to cover plate 38. To back up supporting plate 39, two supporting rollers 84, 84, each rotatable about a horizontal stud 83, are provided in the zone of the front end of baseplate 41, and work supporting plate 39 rests against one of these rollers 84 directly and against the other roller 84 through cover plate 38.

As also shown in FIG. 2, baseplate 41 is provided in the zone of its front end with an insert designed as a needle plate 85 having an elongated slot 86 for the buttonhole knife 64 and a needle hole 87 for the needle 10 and projecting into a recess 88 of the cover plate 38 which covers the work supporting plate 39.

The sliding member 74 secured to intermediate plate 40 has a substantially U-shape cross-section with outwardly bent legs engaging the baseplate 41 from below and it serves for supporting a shaped part 89 which forms a part of a coupling 91 provided between a stepping mechanism 90 and work clamp 21. Shaped part 89, which is pivotally mounted on a pin 92 secured to the sliding member 74, is received in a conformable recess 93 of an embracing match 94 of coupling 91, which is firmly connected to a rod 95. Rod 95 extends substantially parallel to main shaft 5 of the machine and is received in the interior of a threaded spindle 96 designed as a hollow shaft and provided, on its free end portion, with an adjustable abutment 97 for a spring 98 which is provided between abutment 97 and the end of threaded spindle 96 and which holds the shaped part 89 in firm frictional engagement with match 94. Thereby, sliding member 74 is pressure-locked with an angle-shaped support 99 which is connected to threaded spindle 96.

The spindle 96 is surrounded and engaged by a nut 100 which is mounted for rotation on the lower part 1 but is axially fixed so that spindle 96 is moved in either one or the other direction depending on the direction of rotation of nut 100. A belt pulley 101 which cooperates through a cog belt 103 passed around a return pulley 102 with stepping mechanism 90 is secured to nut 100. Stepping mechanism 90 further comprises two eccentrics 104 and 105 which impart a feed motion as well as a spreading or clmping motion to a belt clasp 106, whereby, the motion derived from feed eccentric 104 is transmitted as an intermittent rotary motion to nut 100 through cog belt 103.

The sewing machine operates as follows:

Assuming that arm 2 is in its rest position away from the stitch forming area and that the work is placed on cover plate 38 of base clamping part 23, during the positioning of the work, base clamping part 23 occupies a substantially horizontal position, baseplate 41 rests against support 43 formed by pin 44, and slide 49 projects into recess 47 of pin 44. The dog 32 provided at the lower end of guide rod 30 engages pressure rail 28 from below and pin 33 applies against the lower end of slot 34 since spring 35 is expanded. Top clamping part 22 is held in its lifted position, while base clamping part 23 is loosely supported on pin 44, the vertical mobility of which is limited by slide 49 which, in turn, is held in its effective position by ball 54 engaging recess 53.

To move arm 2 from its rest position into its sewing position, magnet 4 is energized, so that arm 2 performs a pivotal movement about pivot pin 3. Top clamping part 22 moves in synchronism with the arm downwardly, about pivot pin 25. As soon as clamping frame 26 comes into contact with the work, arm 2 is displaced relative to guide rod 30 because spring 35 has a flatter characteristic than spring 46 and, with pressing roller 29 resting against pressure rail 28, spring 35 is compressed.

Guide rod 30 moves upwardly relative to lug 31 until pin 33, which secures the rod against rotation, has reached the upper end of slot 34. Then arm 2 and top clamping part 22 form a rigid unit so that during the further lowering motion of arm 2, spring 46 is compressed until arm 2 attains its sewing position which is fixed by the end position of magnet 4 and in which the spatial relationship between needle 10 or the needle stroke and hook 12 is ensured. Since base clamping part 23 also carries needle plate 85, this plate is thereby pressed down in accordance with the thickness of the work. Thus, the variations in thickness of the work are compensated by the position in height of the needle plate or the base clamping part 23 carrying this plate and the spacing between the upper surface of the work and hook 12, or, assuming a definite position of the needle, to the needle eye, remains constant. Consequently, the length of the needle thread loop forming between the needle eye and the upper surface of the work also remains constant, independently of the work thickness. This results in permanently equal stitch forming conditions which are completely independent of the thickness of the material and ensure a secure sewing.

Since the height of recess 47 in pin 44 exceeds the thickness of slide 49 by a certain amount, pin 44 is able, with the slide 49 engaged in recess 47, to execute this motion within its guide bushing 45, necessary for compensating for the work thickness.

To form the buttonhole seam, needle 10 which penetrates the work upwardly from below and hook 12, are driven through the drive means shown. Pressing roller 29 rolls on pressure rail 28, so that a clamping pressure is produced between top clamping part 22 and base clamping part 23 by compressed spring 46. From the two eccentrics 104 and 105 of the stepping mechanism, an intermittent rotary motion is transmitted through belt clasp 106 and cog belt 103 to belt pulley 101 which is firmly connected to nut 100. Threaded spindle 96 which is secured against rotation is displaced in the direction corresponding to the direction of rotation of nut 100, thereby, moving supporting member 99 connected thereto in a direction which is parallel to the axis of the spindle. Supporting member 99 bears against the front surface of sliding member 74 to which it imparts a motion in the longitudinal direction.

In consequence, intermediate plate 40 which is guided in guideways 71 and 72 by means of guide roller 73 and sliding member 74 executes a longitudinal movement during which pin 77 is displaced within transvere guideway 76 of intermediate plate 40 and, at the same time, within oblique guideway 78 which is provided in baseplate 41. Because work supporting plate 39 is firmly connected to pin 77, this plate executes a sliding motion predetermined by the orientation of this oblique guideway 78 and is guided, in addition, by guide roller 80 which extends through guide slot 82 and is carried by baseplate 41.

Figure 3:
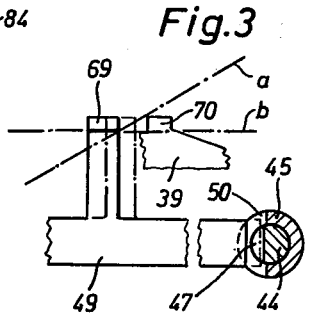
FIG. 3 is a top plan view of a portion of the work clamp.

Bar 70 which is secured to work supporting plate 39 of base clamping part 23 participates in the motion of work clamp 21 and moves along the work feed line a indicated in FIG. 3. Extension 69 of slide 49, which projects into the path of motion of bar 70, is thereby moved along line b which is parallel to the guide path of slide 49, whereby, extension 69 is pushed out of the path of motion of bar 70, with the result that the end portion of slide 49 is disengaged from recess 47 of pin 44 and locking mechanism 48 becomes ineffective, with slide 49 being secured in its ineffective position by ball 54 engaging recess 52. Since the jaw-like recess 55 of slide 49 is larger than the width of arm 56 of angle lever 57, this lever 57 remains in its initial position during the motion of slide 49.

As soon as the sewing of the first buttonhole bead and the corresponding cross-stitches are terminated, the motion to be transmitted by belt clasp 106 to cog belt 103 is reversed by appropriate means (not shown), so that nut 100 is driven oppositely to its previous direction of rotation. Since sliding member 74 is connected to supporting member 99, which is secured to threaded spindle 96, by a pressure-locking contact between shaped part 89, which is pivotally mounted on member 74, and match 94 which is biased by spring 98, the reversal of the direction of motion of work clamp 21 is effected without any play.

At the end of the sewing operation, the sewing machine is stopped with needle 10 in the lowermost position. If there was no response of the thread monitoring device 68 during the formation of the buttonhole seam, this seam has been terminated regularly. In this case, at the second point of interruption bridged by the thread monitoring device 68, the circuit of electromagnet 66 is closed. The cam of the program control device closes the circuit of the magnet at its first point of interruption, whereby, voltage is applied to magnet 66 and lever 61 is moved downwardly. Thereby, knife bar 63 is actuated and the buttonhole is cut open.

Due to the downward movement of lever 61, angle lever 57 is swung clockwise (as viewed in FIG. 1) and its arm moves slide 49 to the lefthand side. Consequently, the end portion of slide 49 engages recess 47 of pin 44. Thereupon, electromagnet 4 is energized, whereby, arm 2 is moved from its sewing position into its rest position. As arm 2 moves upwardly, first spring 46 producing the clamping pressure between top clamping part 22 and base clamping part 23 expands to some extent and then work clamp 21 executes a pivotal movement about pivot pin 42 whereby base clamping part 23 is moved from its sewing position into its feed position which is slightly above the horizontal.

As soon as the end portion of slide 49 engages the lower boundary edge of recess 47, during the further pivotal motion of arm 2, spring 35 expands. This has the effect that during the further upward motion of warm 2, top clamping part 22 remains in contact with the work until pin 33 of guide rod 30 reaches the lower end of slot 34 provided in lug 31. Only at the end of this relative movement between arm 2 and top clamping part 22, which is obtained by the idle stroke of the drive connection between arm 2 and work clamp 21, guide rod 30 which is in its lowermost position, takes the top clamping part 22 along upwardly through dog 32 which engages pressure rail 28 from below. Arm 2 continues its pivotal movement about pivot pin 3 up to its rest position and top clamping part 22 executes a pivotal movement about axis 25 and is held in the rest position of arm 2 by dog 32 engaging pressure rail 28 from below.

In case of a thread breakage during the formation of the buttonhole seam, the thread monitoring device 68 responds and the circuit of electromagnet 66 is interrupted at this second point of interruption. Even though at the end of the sewing cycle, the circuit of electromagnet 66 is closed at the first point of interruption by the cam of the program control device, magnet 66 remains de-energized, so that buttonhole knife 64 is not actuated. Since at the start of the sewing operation, slide 49 has been moved from its locking position into an ineffective position, in the absence of a motion of lever 61, it remains in its position shown in FIG. 1.

Upon energizing of electromagnet 4, arm 2 is moved from its sewing position into its rest position. With the arm moving upwardly, base clamping part 23 and top clamping part 22 are moved in accordance with the motion of the arm. With spring 46 expanding, pin 44 moves upwardly and follows the upward motion of arm 2 up to the rest position thereof. In its end position predetermined by the rest position of arm 2, spring 46 has still a residual tension which ensures the clamping position between top clamping part 22 and base clamping part 23. At the end of the upward movement of arm 2, pin 44 and work clamp 21 including baseplate 41 occupy the position shown in FIG. 1, in which the access to needle 10, which is in its lowermost position, is completely cleared in spite of maintaining the clamping position between base clamping part 23 and top clamping part 22.

If, with arm 2 in rest position, the access to needle 10 is to be cleared for threading of exchange, work clamp 21 can be pivoted about pivot pin 42 independently of arm 2. In this case, sliding member 74 which is firmly connected to intermediate plate 40 follows this pivotal motion, while match 94 which is connected to bar 95, remains in its position.

During the relative movement between sliding member 74 and match 94, shaped part 89 which is mounted on pin 92 executes a pivotal motion about this pin, thereby, changing is relative position to recess 93 of match 94. However, since match 94 is held by spring 98 in pressure-locking engagement with shaped part 89, the drive connection between stepping mechanism 90 and work clamp 21 is re-established in an unchanged manner completely free from play after the clamp has returned into its initial position.

Since with a regularly terminated buttonhole seam, the end portion of slide 49 forming the lock 48 engages recess 47 of pin 44 and the locking position is secured by ball 54 engaging recess 53, if work clamp 21 is lifted manually, pin 44 remains in its position predetermined by the locking mechanism.

While a specific embodiment of the invention has been shown and described in detail to illustrate the application of the principles of the invention, it will be understood that the invention may be embodied otherwise without departing from such principles.

What is claimed is:

1. A sewing machine for sewing a buttonhole in a workpiece, comprising a stationary lower part, an arm having one end pivotally mounted on said lower part and having an opposite end, a rotary hook rotatably mounted adjacent said opposite end of said arm, a needle mounted inssaid lower part for upward and downward reciprocation in cooperation with said rotary hook, drive means connected to said hook and to said needle to operate said hook and said needle in timed relationship, said arm being pivotable relative to said base part for moving said arm from a fixable sewing position with said hook spaced by a predetermined distance from said needle at a stitch forming area to a rest position in which it is spaced away from the stitch forming area, a thread monitoring device mounted on said lower part adjacent said needle, a buttonhole cutting mechanism connected to said drive means to periodically cut the workpiece, a resilient support on said lower part having an upright support member, spring means biasing said support member in an upward direction toward said arm, a workpiece clamp carried by said arm including a base clamping part adapted to rest on said resilient support against the force of said spring means and a top clamping part in the sewing position of said arm rest against said arm, and a locking member engageable with said support member and connected to said thread monitoring device to lock said support member in a selected partly raised position in dependence upon said monitoring deivce to expose said needle for re-threading.

2. A sewing machine according to claim 1, including means associated with said workpiece clamp to move said locking mechanism so as to disengage it from said resilient support, said buttonhole cutting mechanism including a member having a knife movable into engagement with the workpiece and being effective to return said locking mechanism into its effective position in engagement with said resilient support.

3. A sewing machine according to claim 1, wherein said locking mechanism comprises a slide, means mounting said slide for movement toward and away from said resilient support, said slide having an upwardly extending extension projecting into the path of motion of said workpiece clamping part and including a drive transmission operating with an idle stroke connected between said drive means and said buttonhole cutting mechanism.

4. A sewing machine according to claim 3, including means for arresting said slide in both its effective and rest positions.

* * * * *